US012510079B2

(12) United States Patent
Busch

(10) Patent No.: US 12,510,079 B2
(45) Date of Patent: Dec. 30, 2025

(54) COMPENSATION MECHANISM FOR A DISPLACEMENT MACHINE

(71) Applicant: OET GMBH, Lustenau (AT)

(72) Inventor: Christian Busch, Feldkirch (AT)

(73) Assignee: OET GMBH, Lustenau (AT)

( * ) Notice: Subject to any disclaimer, the term of this patent is extended or adjusted under 35 U.S.C. 154(b) by 0 days.

(21) Appl. No.: 18/842,099

(22) PCT Filed: Feb. 9, 2023

(86) PCT No.: PCT/EP2023/053232
§ 371 (c)(1),
(2) Date: Aug. 28, 2024

(87) PCT Pub. No.: WO2023/161035
PCT Pub. Date: Aug. 31, 2023

(65) Prior Publication Data

US 2025/0172145 A1 May 29, 2025

(30) Foreign Application Priority Data

Feb. 28, 2022 (DE) ..... 102022104746.6

(51) Int. Cl.
*F04C 18/02* (2006.01)
*F04C 29/00* (2006.01)

(52) U.S. Cl.
CPC ..... *F04C 29/0057* (2013.01); *F04C 18/0215* (2013.01); *F04C 2240/50* (2013.01)

(58) Field of Classification Search
CPC .. F04C 29/0057; F04C 18/0215; F04C 18/02; F04C 2240/50; F04C 2240/80; F04C 2240/807; F04C 2240/60; F01C 1/0215
See application file for complete search history.

(56) References Cited

U.S. PATENT DOCUMENTS 4,522,574 A * 6/1985 Arai ..... F04C 29/0057 418/55.3
4,824,346 A * 4/1989 Hiraga ..... F01C 1/0215 418/57

(Continued)

FOREIGN PATENT DOCUMENTS

DE 3338737 A1 3/1984
DE 102019108079 A1 10/2019

(Continued)

OTHER PUBLICATIONS

International Search Report and Written Opinion received for PCT Application No. PCT/EP2023/053232 on Apr. 21, 2023, 14 pgs.

(Continued)

*Primary Examiner* — Dapinder Singh
(74) *Attorney, Agent, or Firm* — Merchant & Gould P.C.

(57) ABSTRACT

The invention relates to a compensation mechanism for a displacement machine according to the spiral principle, in particular a scroll compressor, wherein the compensation mechanism comprises a driveshaft with a central axis S and a compensation device, which comprises a cylindrical hub element that is mounted on a first eccentric pin of the driveshaft such that it can rotate about an axis of rotation P, and a compensation element which is mounted on the hub element such that it can rotate about an axis of rotation J and which has an eccentrically arranged slotted hole extending in the radial direction relative to the axis of rotation J, wherein a second eccentric pin of the driveshaft is guided in the slotted hole of the compensation element such that a Scotch yoke is formed between the slotted hole and the axis of rotation J of the compensation element. The invention also relates to a displacement machine comprising a compensation mechanism of this type.

16 Claims, 3 Drawing Sheets

(56) References Cited

U.S. PATENT DOCUMENTS

| | | | | |
|---|---|---|---|---|
| 10,400,771 | B2 * | 9/2019 | Valdez | F16D 3/04 |
| 11,193,490 | B2 * | 12/2021 | Kuma | F04C 18/0215 |
| 11,655,819 | B2 * | 5/2023 | Ichise | F04C 29/0057 418/55.1 |
| 2010/0166589 | A1 * | 7/2010 | Iwano | F04C 29/0057 418/55.1 |
| 2015/0078945 | A1 | 3/2015 | Xiaogeng | |

FOREIGN PATENT DOCUMENTS

| | | | |
|---|---|---|---|
| DE | 102020121442 | A1 | 2/2022 |
| JP | S56129791 | A | 10/1981 |
| JP | S5979086 | A | 5/1984 |
| JP | S61261688 | A | 11/1986 |
| JP | H04321785 | A | 11/1992 |
| JP | H09195957 | A | 7/1997 |
| JP | 2004293331 | A | 10/2004 |

OTHER PUBLICATIONS

Japanese Office Action received for JP Application No. 2024-550580 on Sep. 30, 2025, 3 pgs.

* cited by examiner

COMPENSATION MECHANISM FOR A DISPLACEMENT MACHINE

CROSS-REFERENCE TO RELATED APPLICATION

The present application is a National Stage Application of PCT International Application No.: PCT/EP2023/053232 filed on Feb. 9, 2023, which claims priority to German Patent Application 10 2022 104 746.6, filed with the German Patent Office on Feb. 28, 2022, the disclosure of which is incorporated herein by reference in its entirety.

PRIOR ART

The invention relates to a compensation mechanism for a displacement machine according to the spiral principle, in particular for a scroll compressor, as well as to a displacement machine according to the spiral principle with such a compensation mechanism.

Scroll compressors comprising a compensation mechanism are known from prior art, for example from DE 10 2020 121 442 A1 going back to the applicant. The compensation mechanism is used to compensate for manufacturing tolerances and ensure them in such a way that two displacement spirals nested one inside of the other fit tightly together. In addition, existing oscillations, vibrations and noises are reduced. Additional scroll compressors with such compensation mechanisms are known from U.S. Pat. No. 4,824,346 A and DE 10 2019 108 079 A1, for example.

TECHNICAL FIELD

Proceeding from this prior art, the object of the invention is to further develop a compensation mechanism for a displacement machine according to the spiral principle, in particular scroll compressors, so as to achieve an improved reduction in vibrations given a low component complexity. Another object of the invention is to indicate a displacement machine according to the spiral principle, in particular a scroll compressor, with such a compensation mechanism.

Within the framework of the present invention, this object is achieved with respect to the compensation mechanism by the subject matter of claim 1, and with respect to the displacement machine by the subject matter of claim 15.

TECHNICAL BACKGROUND

In this regard, the invention is based on the idea of indicating a compensation mechanism for a displacement machine according to the spiral principle, in particular scroll compressors, wherein the compensation mechanism has a driveshaft with a center axis S and a compensation device. The compensation device has a cylindrical hub element, which is mounted on a first eccentric pin of the driveshaft so that it can rotate around an axis of rotation P. The compensation device further has a compensation element, which is mounted on the hub element so that it can rotate around an axis of rotation J and has an eccentrically arranged slotted hole that extends in a radial direction in relation to the axis of rotation J. A second eccentric pin of the driveshaft is guided in the slotted hole of the compensation element in such a way that a Scotch yoke is formed between the slotted hole and the axis of rotation J of the compensation element.

The invention now preferably uses a single compensation element to achieve a reduction in vibrations, and thereby contribute to a very smooth running of a displacement machine. The slotted hole of the compensation element here ensures that a movement by the compensation element in a radial direction is limited in relation to the center axis S of the driveshaft. Together with the second eccentric pin, the slotted hole thus prescribes a direction of movement for the compensation element, which essentially forms a Scotch yoke. Therefore, a combined swinging and linear movement essentially takes place. It turned out that this movement in the form of a Scotch yoke compensates for manufacturing tolerances especially well, and thus guarantees a seal between two displacement spirals with a high efficiency. At the same time, the compensation mechanism according to the invention here reduces vibrations inside of a displacement machine. In a preferred embodiment of the invention, a center of gravity of the compensation element has an oscillating component during operation, wherein the center of gravity oscillates around a connecting line JQ between the axis of rotation J of the compensation element and a center axis Q of the slotted hole. The center of gravity of the compensation element can be arranged radially outside of the center axis Q of the slotted hole, in particular in relation to the center axis S of the driveshaft. In this position, the Scotch yoke of the compensation element ensures that the center of gravity of the compensation element has a oscillating component, and efficiently uses the latter to compensate for manufacturing tolerances in the circumferential direction of the driveshaft.

The center of gravity of the compensation element can additionally have a linear component during operation, wherein the center of gravity moves along the connecting line JQ, and wherein the linear component is larger than the oscillating component. The linear component is mainly prescribed by the slotted hole, which to this extent limits a rotational or oscillating movement of the compensation element. The linear component of the movement of the center of gravity of the compensation element, which preferably is directed in a radial direction relative to the center axis of the driveshaft, is especially advantageous for damping vibrations and the seal between displacement spirals.

The compensation element has the axis of rotation J, and the hub element comprises a center axis C. In an especially preferred variant of the invention, the axis of rotation J of the compensation element is arranged concentrically to a center axis C of the hub element. In other words, the axis of rotation J of the compensation element and the center axis C of the hub element can be congruent. This configuration reduces the complexity of the compensation mechanism, and limits the degrees of freedom of movement of the compensation mechanism to a level expedient for reducing vibrations.

The hub element can further have an eccentric hub bore, in which the first eccentric pin of the driveshaft is arranged. Overall, the compensation mechanism advantageously has a multiple eccentricity, so as to achieve a good seal between the displacement spirals and a noise reduction during the operation of a displacement machine due to the resultant movement sequence.

Another variant of the invention provides that the compensation element have a reception bore, with which the compensation element is rotatably mounted on the hub element. In this way, the movement sequence advantageous for vibration reduction is transferred from the driveshaft until into the movable displacement spiral, wherein the reception bore forms one of several swivel joints for the movement sequence.

The compensation element itself can have a guide section and equalizing weight. The equalizing weight preferably extends around the guide section like an arc. It was found that such a configuration of the compensation element leads to an especially good weight equalization in each operating state of the compensation mechanism. The vibration reduction is achieved especially well in this way.

The reception bore and the slotted hole are preferably arranged in the guide section. In this regard, the guide section establishes a connection between the axis of rotation of the compensation element and the equalizing weight, which is arranged as radially outside of the axis of rotation of the compensation element as possible, so as to be designed as small as possible due to the leverage effect. At the same time, it is provided that the distance between the axis of rotation of the compensation element and the equalizing weight be kept short enough to enable the compact integration of the compensation mechanism into a displacement machine.

An especially preferred embodiment in which the equalizing weight extends half-annularly around the axis of rotation J of the compensation element also helps contribute to the compactness of the compensation mechanism.

In particular for stability reasons, it is especially preferred that the guide section and the equalizing weight be designed as a single piece, in particular monolithically. As a whole, the compensation element can be designed as a one-piece component or monolithic component.

Another variant of the invention provides that the first eccentric pin of the driveshaft have a larger diameter than the second eccentric pin of the driveshaft. Alternatively or additionally, it can be provided that the first eccentric pin of the driveshaft have a larger length than the second eccentric pin of the driveshaft. Furthermore, the hub element can protrude along its center axis C over the compensation element, in particular the equalizing weight. The first and the second eccentric pins of the driveshaft transfer various forces, and are therefore preferably differently dimensioned. This serves to optimize the weight. By contrast, the hub element preferably extends until into an orbiting displacement spiral, and therefore protrudes over the compensation element, so that it can transfer a rotational movement to the first displacement spiral.

In order to ensure a smoothest possible running of the hub element around the first eccentric pin, it can be provided that the hub element be rotatably mounted on the first eccentric pin of the driveshaft via a plain or needle bearing. Alternatively or additionally, the compensation element can be rotatably mounted on the hub element via a plain or needle bearing. A secondary aspect of the invention relates to a displacement machine according to the spiral principle, in particular a scroll compressor, with a compensation mechanism described above. The displacement machine according to the invention can provide that the hub element carry a scroll bearing, which is connected with a movable, in particular operationally orbiting, displacement spiral, wherein the movable displacement spiral engages into a stationary displacement spiral.

BRIEF DESCRIPTION OF THE DRAWINGS

The invention will be explained in more detail below based on exemplary embodiments with reference to the attached schematic drawings. Shown therein on.

DETAILED DESCRIPTION OF THE INVENTION

Figure 1:
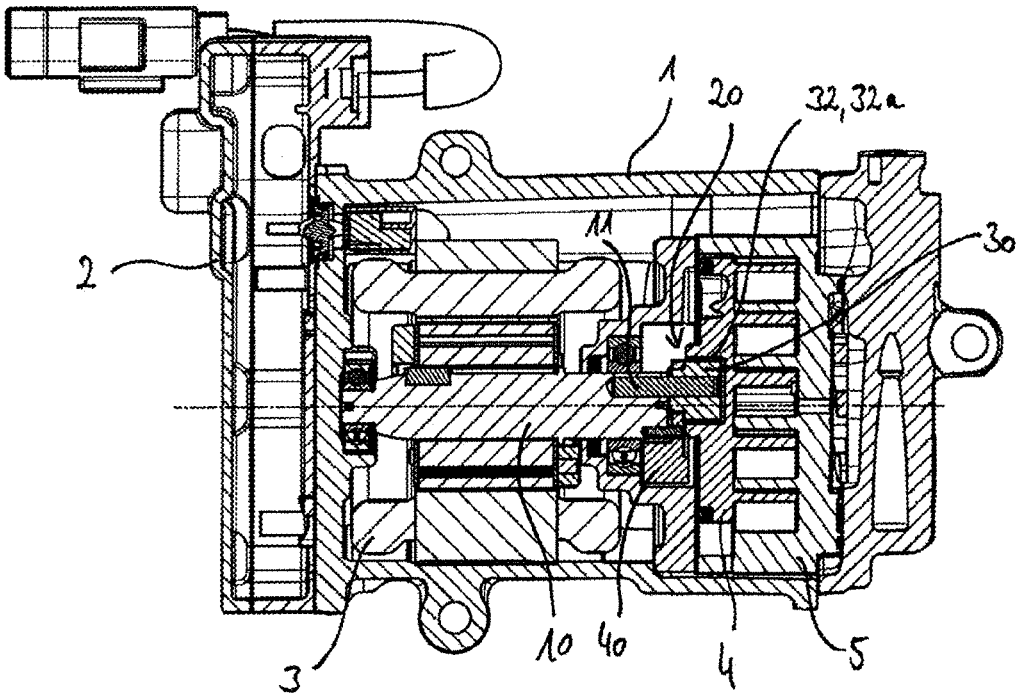
FIG. 1 is a cross sectional view of a displacement machine according to the invention based on the spiral principle with a compensation mechanism according to a preferred exemplary embodiment, wherein the hub element is in contact with a movable displacement spiral via a plain bearing.
Figure 2:
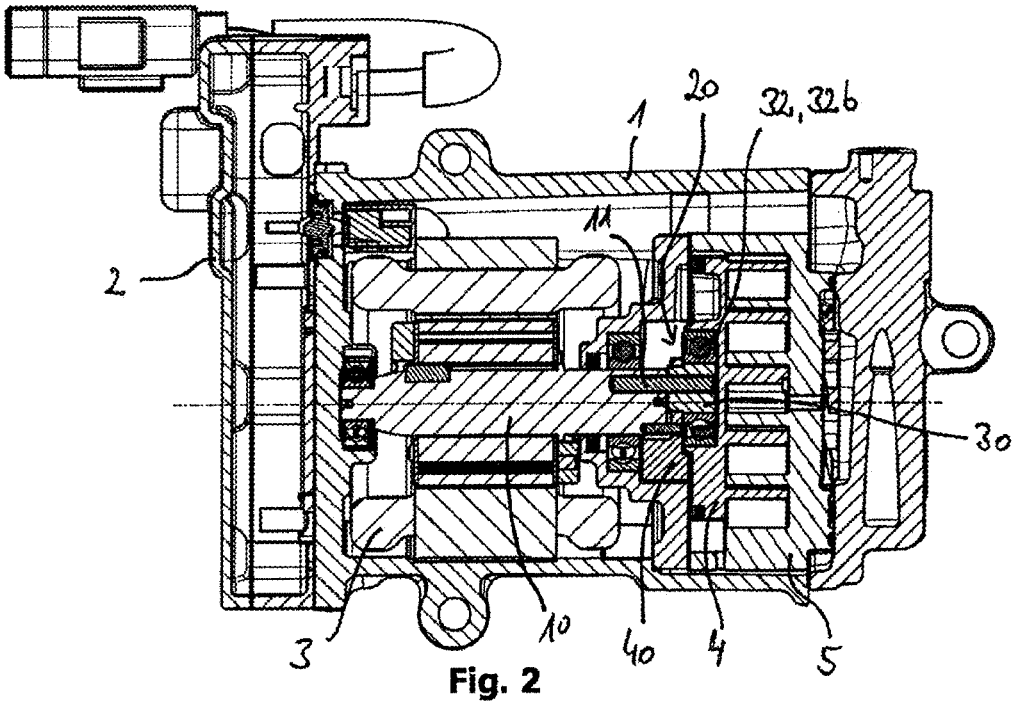
FIG. 2 is a cross sectional view of a displacement machine according to the invention based on the spiral principle with a compensation mechanism according to another exemplary embodiment, wherein the hub element is in contact with the movable displacement spiral via a ball bearing.

Shown on FIGS. 1 and 2 are respective displacement machines according to the spiral principle, which are largely identical in structure. The exemplary embodiments according to FIGS. 1 and 2 only differ with respect to the type of a scroll bearing 32, which is arranged between a hub element 30 and a movable displacement spiral 4. While a plain bearing 32*a* is provided as the scroll bearing 32 in the exemplary embodiment according to FIG. 1, the exemplary embodiment according to FIG. 2 comprises a ball bearing 32*b* as the scroll bearing 32.

In general, the displacement machine according to FIGS. 1 and 2 respectively comprises a compressor housing 1 to which an electronics housing 2 is connected. Positioned inside of the compressor housing 1 is an electric motor 3, which drives a driveshaft 10. The driveshaft 10 uses an eccentric mechanism to act on a movable displacement spiral 4, which carries out an orbiting movement during operation. The movable displacement spiral 4 here engages into a stationary displacement spiral 5, wherein the engagement and orbital movement yield variable compression chambers between the spiral walls of the displacement spirals 4, 5.

Figure 3:
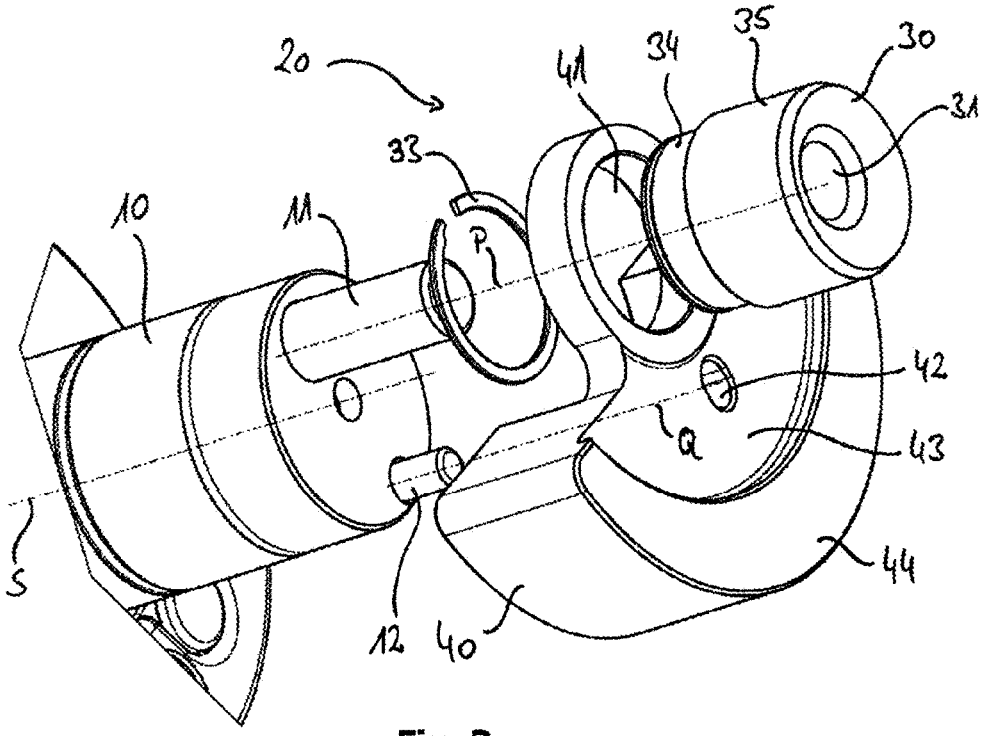
FIG. 3 is an exploded view of a compensation mechanism according to the invention based on a preferred exemplary embodiment.

The eccentric mechanism between the driveshaft 10 and the movable displacement spiral 4 is designed as part of a compensation mechanism, which in the following is described in more detail based on FIGS. 3 to 5.

The compensation mechanism comprises the drive shaft 10 and a compensation device 20. The compensation device 20 essentially connects the driveshaft 10 with the movable displacement spiral 4. The compensation device 20 has a multipart design, and in particular comprises a hub element 30 and a compensation element 40. The hub element 30 is rotatably arranged on a first eccentric pin 11 of the driveshaft 10. For this purpose, the hub element 30 has a hub bore 31, into which the first eccentric pin 11 engages. A plain bearing or a needle bearing can be formed between the first eccentric pin 11 and the hub bore 31.

The hub element 30 comprises a reception segment 34 and a scroll segment 35. The reception segment 34 faces the driveshaft 10, while the scroll segment 35 faces the movable displacement spiral 4, and preferably carries the scroll bearing 32. The scroll segment 35 and the reception segment 34 each have a cylindrical outer contour, wherein the reception segment 34 has a smaller cross sectional diameter than the scroll segment 35.

The reception segment 34 accommodates the compensation element 40. Specifically, the compensation element 40 has a reception bore 41, through which the scroll segment 35 extends. The scroll segment 35 extends in the direction of the driveshaft 10 beyond the reception bore 41, and in the protruding section carries a ring groove for receiving a circlip 33. In this way, the compensation element 40 is longitudinally secured on the hub element 30.

In general, the compensation element 40 is rotatably mounted on the hub element 30. In this regard, the reception segment 34 can form a plain bearing for the reception bore 41 of the compensation element 40. Because the compensation element 40 is rotatably arranged on the hub element 30, the eccentric connection between the first eccentric pin 11 and the movable displacement spiral 4 is decoupled from the equalizing weight 44 with respect to the compensation device 20. This yields an especially good seal between the displacement spirals 4, 5. The variable compression chambers are thus well sealed. At the same time, decoupling the equalizing weight 44 results in a smooth running.

The compensation element 40 comprises a guide section 43, which carries the reception bore 41. Further provided is an equalizing weight 44 that essentially extends in a semi-annular or arched shape around the guide section 43. In particular, the equalizing weight 44 can extend in an arc around the reception bore 41. The equalizing weight 44 preferably has a larger depth than the guide section 43.

Further arranged in the guide section 43 is a slotted hole 42, which extends through the guide section 43, and whose longer transverse axis is aligned essentially radially to the axis of rotation of the compensation element. The slotted hole 42 takes a second eccentric pin 12 of the driveshaft 10, wherein a width of the slotted hole 42 along the shorter transverse axis of the slotted hole 42 essentially corresponds to the diameter of the second eccentric pin 12. The length of the slotted hole 42 as measured along the longer transverse axis of the slotted hole 42 is correspondingly larger than the diameter of the second eccentric pin 12.

Figure 4:
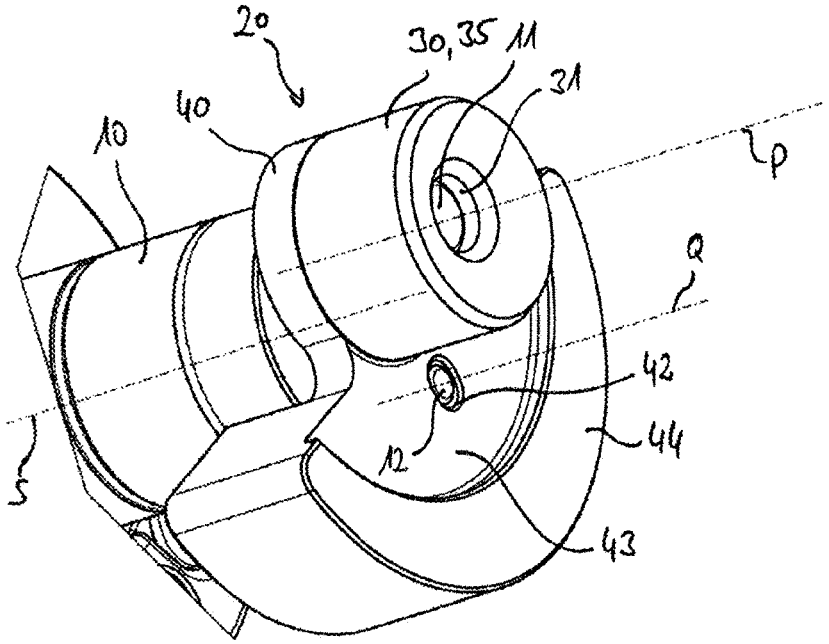
FIG. 4 is a perspective view of the compensation mechanism according to FIG. 3 in an assembled state.

As shown in the assembled state of the compensation device 20 according to FIG. 4, the first eccentric pin 11 engages into the hub bore 31, and the second eccentric pin 12 engages into the slotted hole 42. The first eccentric pin 11 here extends beyond the compensation element 40, but ends inside of the hub bore 31. The second eccentric pin 12 ends inside of the slotted hole 42, meaning that it does not extend beyond the slotted hole 42.

Figure 5:
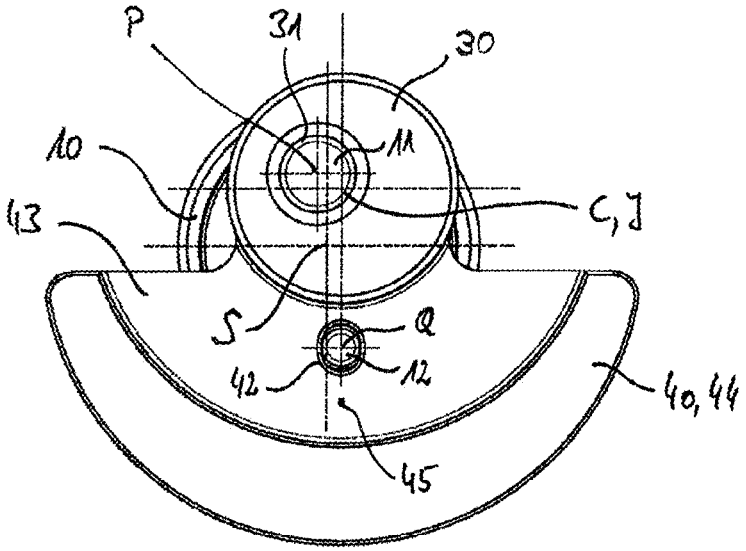
FIG. 5 is a top view of the compensation mechanism according to FIG. 3.

In a front view of the compensation device 20, FIG. 5 shows the position of the different axes crucial for the movement of the compensation mechanism. The driveshaft 10 has a center axis S, which essentially forms the axis of rotation of the driveshaft 10.

The hub element 30 has a center axis C, which extends centrally through the hub element 30. The hub bore 31 of the hub element 30 is eccentrically formed in the hub element 30. A center axis of the hub bore 31 forms the axis of rotation P of the hub element 30. Consequently, the hub element 30 rotates around the axis of rotation P, which is defined by the center axis of the hub bore 31 or the center axis of the first eccentric pin 11.

The compensation element 40 rotates around an axis of rotation J that is defined by the center axis of the reception bore 41. In the present exemplary embodiment, the axis of rotation J of the compensation element 40 coincides with the center axis C of the hub element 30. However, it is also possible for the reception bore 41 to be aligned eccentrically to the center axis C of the hub element, so that the axis of rotation J of the compensation element 40 is arranged outside of the center axis C of the hub element 30. For example, the reception segment 34 of the hub element 30 can be eccentric in design.

The slotted hole 42 has a center axis Q that extends in the bore direction of the slotted hole 42, i.e., runs parallel to the center axis S of the driveshaft 10. The position of the center axis Q of the slotted hole 42 is defined by the intersection of the two transverse axes of the slotted hole 42.

The compensation element 40 further has a center of gravity 45 that is located in the guide section 43. The center of gravity 45 preferably lies radially outside of the slotted hole 42 or the center axis Q of the slotted hole 42, wherein "radially outside" must be understood in relation to the axis of rotation J of the compensation element 40.

During operation, a Scotch yoke forms between the axis of rotation P of the hub element 30, the axis of rotation J of the compensation element 40 and the center axis Q of the slotted hole 42, and ensures that the center of gravity 45 during operation of the compensation device 20 performs a movement that on the one hand has a linear component, which extends in the radial direction along the connecting line JQ between the axis of rotation of the compensation element 40 and the center axis Q of the slotted hole 42, and on the other hand has an oscillating component, which is essentially aligned in the circumferential direction around the axis of rotation J of the compensation element 40. The linear component of the movement of the center of gravity 45 is larger than the circumferential component or oscillating component. This type of movement, in particular the linear component, leads to a significant reduction in oscillations inside of a displacement machine and a reduction in noise.

The invention claimed is:

1. A compensation mechanism for a displacement machine according to the spiral principle, wherein the compensation mechanism comprises a driveshaft with a center axis and a compensation device which includes:

a cylindrical hub element that is mounted on a first eccentric pin of the driveshaft so that it can rotate around an axis of rotation, and a compensation element which is mounted on the hub element so that it can rotate around an axis of rotation, and has an eccentrically arranged slotted hole that extends in a radial direction in relation to the axis of rotation of the compensation element, wherein a second eccentric pin of the driveshaft is guided in the slotted hole of the compensation element in such a way that a Scotch yoke is formed between the slotted hole and the axis of rotation of the compensation element.

2. The compensation mechanism according to claim 1, wherein a center of gravity of the compensation element has an oscillating component during operation, wherein the center of gravity oscillates around a connecting line between the axis of rotation of the compensation element and a center axis of the slotted hole.

3. The compensation mechanism according to claim 2, wherein the center of gravity of the compensation element has a linear component during operation, wherein the center of gravity moves along the connecting line, and wherein the linear component is larger than the oscillating component.

4. The compensation mechanism according to claim 1, wherein the axis of rotation of the compensation element is arranged concentrically to a center axis of the hub element.

5. The compensation mechanism according to claim 1, wherein the axis of rotation of the compensation element is arranged eccentrically to a center axis of the hub element.

6. The compensation mechanism according to claim 1, wherein the hub element has an eccentric hub bore, in which the first eccentric pin of the driveshaft is arranged.

7. The compensation mechanism according to claim 1, wherein the compensation element has a reception bore, with which the compensation element is rotatably mounted on the hub element.

8. The compensation mechanism according to claim 7, wherein the compensation element has a guide section and an equalizing weight, wherein the equalizing weight extends in an arc around the guide section.

9. The compensation mechanism according to claim 8, wherein the reception bore and the slotted hole are arranged in the guide section.

10. The compensation mechanism according to claim 8, wherein the equalizing weight extends half-annularly around the axis of rotation of the compensation element.

11. The compensation mechanism according to claim 8, wherein the guide section and the equalizing weight are designed as a single piece.

12. The compensation mechanism according to claim 1, wherein the first eccentric pin of the driveshaft has a larger diameter and/or a larger length than the second eccentric pin of the driveshaft.

13. The compensation mechanism according to claim 1, wherein the hub element protrudes along a center axis thereof over the compensation element.

14. The compensation mechanism according to claim 1, wherein the hub element is rotatably mounted on the first eccentric pin of the driveshaft via a plain or needle bearing and/or the compensation element is rotatably mounted on the hub element via a plain or needle bearing.

15. A displacement machine according to the spiral principle, comprising a compensation mechanism according to claim 1.

16. The displacement machine according to claim 15, wherein, the hub element carries a scroll bearing which is connected with a movable displacement spiral, wherein the movable displacement spiral engages into a stationary displacement spiral.

* * * * *